US012089648B1

(12) United States Patent
He

(10) Patent No.: US 12,089,648 B1
(45) Date of Patent: Sep. 17, 2024

(54) ELECTRONIC CIGARETTE ASSEMBLY WITH EXTENDED SERVICE LIFE

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/594,929

(22) Filed: Mar. 4, 2024

(30) Foreign Application Priority Data

Feb. 4, 2024 (CN) ..... 202420277724.X

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/70*** | (2020.01) |

(52) U.S. Cl.
CPC ..... *A24F 40/485* (2020.01); *A24F 40/10* (2020.01); *A24F 40/42* (2020.01); *A24F 40/44* (2020.01); *A24F 40/46* (2020.01); *A24F 40/70* (2020.01)

(58) Field of Classification Search
CPC ..... A24F 40/485; A24F 40/10; A24F 40/40; A24F 40/42; A24F 40/44
See application file for complete search history.

(56) References Cited

U.S. PATENT DOCUMENTS

| | | | | |
|---|---|---|---|---|
| 10,945,455 | B1 * | 3/2021 | Wang | A24F 40/46 |
| 11,129,409 | B2 * | 9/2021 | Xiao | A24F 7/00 |
| 11,871,794 | B2 * | 1/2024 | Qiu | A24F 40/485 |
| 2017/0156408 | A1 * | 6/2017 | Li | A24F 40/40 |
| 2018/0000156 | A1 * | 1/2018 | Qiu | A24F 40/40 |
| 2024/0023622 | A1 * | 1/2024 | Qu | A24F 40/485 |

* cited by examiner

*Primary Examiner* — Hae Moon Hyeon

(57) ABSTRACT

An electronic cigarette assembly includes an electronic cigarette body and an expanded tobacco liquid bottle. The electronic cigarette body includes a storage chamber. The storage chamber is provided with first liquid absorbing cotton and a first liquid passing hole. The expanded tobacco liquid bottle stores tobacco liquid and is provided with second liquid passing holes and a movable part. When the expanded tobacco liquid bottle is not assembled with the electronic cigarette body, the movable part covers the second liquid passing holes to prevent the tobacco liquid from flowing out of the second liquid passing holes. When the expanded tobacco liquid bottle is assembled with the electronic cigarette body, the movable part moves to open the second liquid passing holes, allowing the tobacco liquid to pass through the second liquid passing holes and the first liquid passing hole to be adsorbed by the first liquid absorbing cotton.

20 Claims, 12 Drawing Sheets

ELECTRONIC CIGARETTE ASSEMBLY WITH EXTENDED SERVICE LIFE

CROSS-REFERENCE TO RELATED APPLICATIONS

The application claims priority of Chinese patent application CN202420277724X, filed on Feb. 4, 2024, which is incorporated herein by reference in its entireties.

TECHNICAL FIELD

The present invention relates to a technical field of electronic cigarettes, in particular to an electronic cigarette assembly.

BACKGROUND ART

An electronic cigarette uses an atomizer to heat and atomize tobacco liquid to form aerosol, and when the user exhales the aerosol, an effect of puffing is achieved. At present, an existing disposable electronic cigarette has a small volume for storing tobacco liquid, a fixed capacity for tobacco liquid and short usage time, thereby failing to meet needs of the user. Therefore, there is an urgent need on the market to provide an tobacco liquid bottle that is capable of expanding the tobacco liquid of the disposable electronic cigarette, in order to extend a service life of the disposable electronic cigarette.

SUMMARY

A main purpose of the present invention is to provide an electronic cigarette assembly for solving the problem of short usage time of the existing disposable electronic cigarette.

In order to solve the above-mentioned technical problem, a technical solution is provided by the present invention.

An electronic cigarette assembly includes an electronic cigarette body and an expanded tobacco liquid bottle installed on the electronic cigarette body.

The electronic cigarette body includes a storage chamber. The storage chamber is equipped with first liquid absorbing cotton for storing tobacco liquid. The storage chamber is provided with a first liquid passing hole in communication with an interior.

The expanded tobacco liquid bottle is configured for storing tobacco liquid, and the expanded tobacco liquid bottle is provided with second liquid passing holes. The expanded tobacco liquid bottle is equipped with a movable part.

When the expanded tobacco liquid bottle is not assembled with the electronic cigarette body, the movable part covers the second liquid passing holes to prevent tobacco liquid from flowing out of the second liquid passing holes.

When the expanded tobacco liquid bottle is assembled with the electronic cigarette body, the movable part moves to open the second liquid passing holes, and the second liquid passing holes are in communication with the first liquid passing hole.

Furthermore, the electronic cigarette body includes a connection seat provided on the storage chamber. An upper surface of the connection seat is further provided with an embedding slot, and the embedding slot is in communication with the first liquid passing hole. The embedding slot is equipped with pushing members. A perforating hole is provided on the expanded tobacco liquid bottle, and the perforating hole runs through the expanded tobacco liquid bottle from top to bottom.

When the expanded tobacco liquid bottle is assembled with the electronic cigarette body, the expanded tobacco liquid bottle is sleeved on an outer side of the storage chamber, and at least part of the storage chamber is placed in the perforating hole. A bottom end of the expanded tobacco liquid bottle is placed in the embedding slot. When the bottom end of the expanded tobacco liquid bottle is placed in the embedding slot, the movable part abuts against the pushing members and is pushed upwards to open the first liquid passing hole, so that the second liquid passing holes are in communication with the perforating hole. Alternatively, when the bottom end of the expanded tobacco liquid bottle is placed in the embedding slot, the movable part engages with the pushing members, and when the expanded tobacco liquid bottle rotates relative to the electronic cigarette body, the movable part is pushed by the pushing members to open the first liquid passing hole, so that the second liquid passing holes are in communication with the perforating hole.

A joint structure is provided between a side wall of the embedding slot and the expanded tobacco liquid bottle. The joint structure includes a fixed slot and a convex block. When the bottom end of the expanded tobacco liquid bottle is placed in the embedding slot, the convex block is placed in the fixed slot.

Furthermore, the connection seat is provided with a connection protruding stage on the embedding slot. The pushing members are provided on the connection protruding stage. The fixed slot is positioned on an outer side wall of the connection protruding stage, and the convex block is positioned on a side wall of the perforating hole.

Furthermore, a first sealing ring is provided between the connection protruding stage and the expanded tobacco liquid bottle. The first sealing ring is positioned below the joint structure.

Furthermore, an annular cavity is provided inside the expanded tobacco liquid bottle for storing tobacco liquid. The annular cavity is arranged around the perforating hole, and the second liquid passing holes are arranged on a side wall of the perforating hole. A total number of the second liquid passing holes is multiple, and position limiting columns are provided between two adjacent second liquid passing holes.

The movable part includes a bottom plate and an enclosure wall set on the bottom plate. The enclosure wall is placed inside the annular cavity. Position limiting holes are provided on the bottom plate. The position limiting columns are placed inside the position limiting holes. The bottom plate is at least partially placed inside the perforating hole and used in conjunction with the pushing members.

Furthermore, the expanded tobacco liquid bottle includes a first housing body and a first bottom housing, and the first bottom housing is arranged at a bottom of the first housing body.

The first housing body includes a first annular wall, a second annular wall positioned within the first annular wall, and a top wall. Two sides of the top wall are respectively connected to the first annular wall and the second annular wall. A second sealing ring is provided between the second annular wall and the enclosure wall.

The first bottom housing includes a third annular wall, a fourth annular wall, and a bottom wall. Two sides of the bottom wall are respectively connected to the third annular wall and the fourth annular wall. The first annular wall is connected to the third annular wall. A third sealing ring is arranged between the first annular wall and the third annular wall, and a fourth sealing ring is provided between the enclosure wall and the third annular wall.

The second liquid passing holes are positioned on the fourth annular wall. An annular chamber is composed of the first annular wall, the second annular wall, the top wall, the third annular wall, the fourth annular wall, and the bottom wall. The convex block is positioned on the fourth annular wall.

Furthermore, a bottom of the second sealing ring is connected to an annular rubber ring. An upper surface and a lower surface of the annular rubber ring respectively abut against a top surface of the second annular wall and the position limiting columns.

Furthermore, a total number of the pushing members is multiple and the pushing members are evenly distributed.

A rubber ring protrusion is provided on an inner side of the annular rubber ring, and the rubber ring protrusion protrudes from a side wall of the perforating hole.

Furthermore, the third sealing ring is connected to the fourth sealing ring, and a fifth sealing ring is provided at a bottom of the fourth sealing ring. The fifth sealing ring is positioned between the third annular wall and the fourth annular wall. A top surface of the fifth sealing ring is at least partially opposite to a bottom surface of the bottom plate.

The third sealing ring, the fourth sealing ring and the fifth sealing ring are integrally formed by injection molding, and the sixth rubber ring and the annular rubber ring are integrally formed by injection molding.

Furthermore, the electronic cigarette body further includes a first outer housing, and the first outer housing is sleeved on an outer side of the storage chamber. The first outer housing is equipped with a third liquid passing hole at a position corresponding to the first liquid passing hole. Liquid guiding cotton is arranged between the first liquid passing hole and the third liquid passing hole, and the liquid guiding cotton is used for guiding the tobacco liquid from the expanded tobacco liquid bottle into the storage chamber.

Furthermore, the liquid guiding cotton is in an annular shape and is sleeved on an outer side wall of the storage chamber. A height of the liquid guiding cotton is greater than a height of the first liquid passing hole or the third liquid passing hole.

Furthermore, a bottom of the storage chamber is equipped with an atomizer and a mouthpiece, and the mouthpiece is provided on the first outer housing. An opening is defined at a top of the storage chamber, and a sealing rubber plug is provided at the opening. An aerosol passing hole is provided on the mouthpiece. The sealing rubber plug is provided with an aerosol outlet hole, and the aerosol outlet hole is internally in communication with the aerosol passing hole and the storage chamber.

Furthermore, second liquid absorbing cotton is provided inside the aerosol passing hole for tobacco liquid absorbing and/or filtration.

Furthermore, the electronic cigarette body further includes a second outer housing, a circuit board and a battery. The second outer housing is connected to the connection seat and is positioned below the connection seat. The circuit board and the battery are arranged inside the second outer housing. The battery and the atomizer are both electrically connected to the circuit board.

Furthermore, a buffer pad is provided between the battery and an inner side wall of the second outer housing.

Furthermore, an adapter board electrically connected to circuit board is provided at a bottom of the connection seat. A first wiring hole is arranged on the connection seat, and a pin of a heating wire on the atomizer is soldered onto the adapter board through the first wiring hole.

Furthermore, a groove is provided at a bottom of the connection seat, and the electronic cigarette body further includes a first rubber seat. A top of the first rubber seat is in interference fit with the groove. A bottom of the first rubber seat is equipped with a first installation chamber, and the adapter board is placed inside the first installation chamber and is in interference fit with the first installation chamber. A second wiring hole is arranged at a position corresponding to the first wiring hole on the first rubber seat.

Furthermore, the electronic cigarette body further includes a second bottom housing. An upper end and a lower end of the second outer housing are respectively connected to the connection seat and the second bottom housing. The second bottom housing is equipped with a second rubber seat. The second rubber seat is in interference fit with the second bottom housing. A bottom surface of the second rubber seat is provided with a second installation chamber, and the circuit board is placed inside the second installation chamber.

Furthermore, an airflow hole is provided on the second bottom housing, the first rubber seat, the circuit board, the adapter board, and the second rubber seat. A pneumatic switch is provided on the circuit board, and an airflow channel is arranged between the buffer pad, the battery, and the second outer housing.

Furthermore, the electronic cigarette body further includes a light board electrically connected to the circuit board, and the light board is positioned between the second bottom housing and the second rubber seat. The second bottom housing is equipped with support columns and positioning columns. A top surface of the support columns abuts against the circuit board, and positioning holes are provided on the circuit board. The positioning columns are placed inside the positioning holes. An avoidance hole is provided in a middle of the light board. Both the positioning columns and the support columns are placed inside the avoidance hole.

Compared to existing technology, in the present invention, when the expanded tobacco liquid bottle is installed on the electronic cigarette body, the movable part moves to open the second liquid passing holes, so that the second liquid passing holes are in communication with to the first liquid passing hole, allowing the tobacco liquid on the expanded tobacco liquid bottle to pass through the second liquid passing holes and the first liquid passing hole to be adsorbed by the first liquid absorbing cotton, thereby increasing a capacity of the tobacco liquid and prolonging a service life of the electronic cigarette body. Moreover, by setting liquid guiding cotton between the first outer housing and the storage chamber, the tobacco liquid in the expanded tobacco liquid bottle can be effectively restricted from entering the storage chamber, playing a flow limiting role, and the tobacco liquid in the storage chamber can also be prevented from leaking out, playing a role in preventing liquid leakage.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
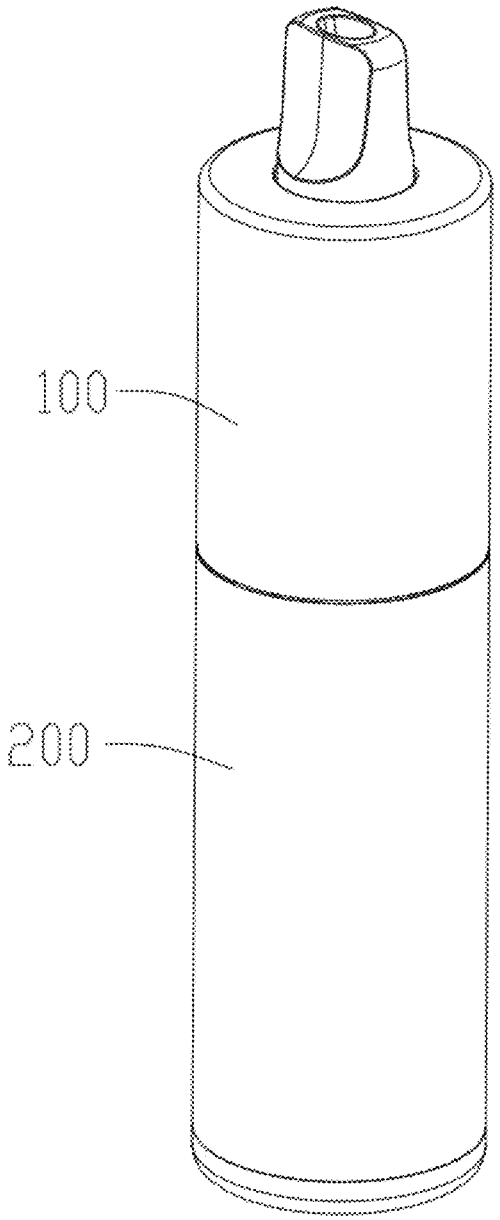
FIG. 1 is a perspective view according to the present invention.
Figure 2:
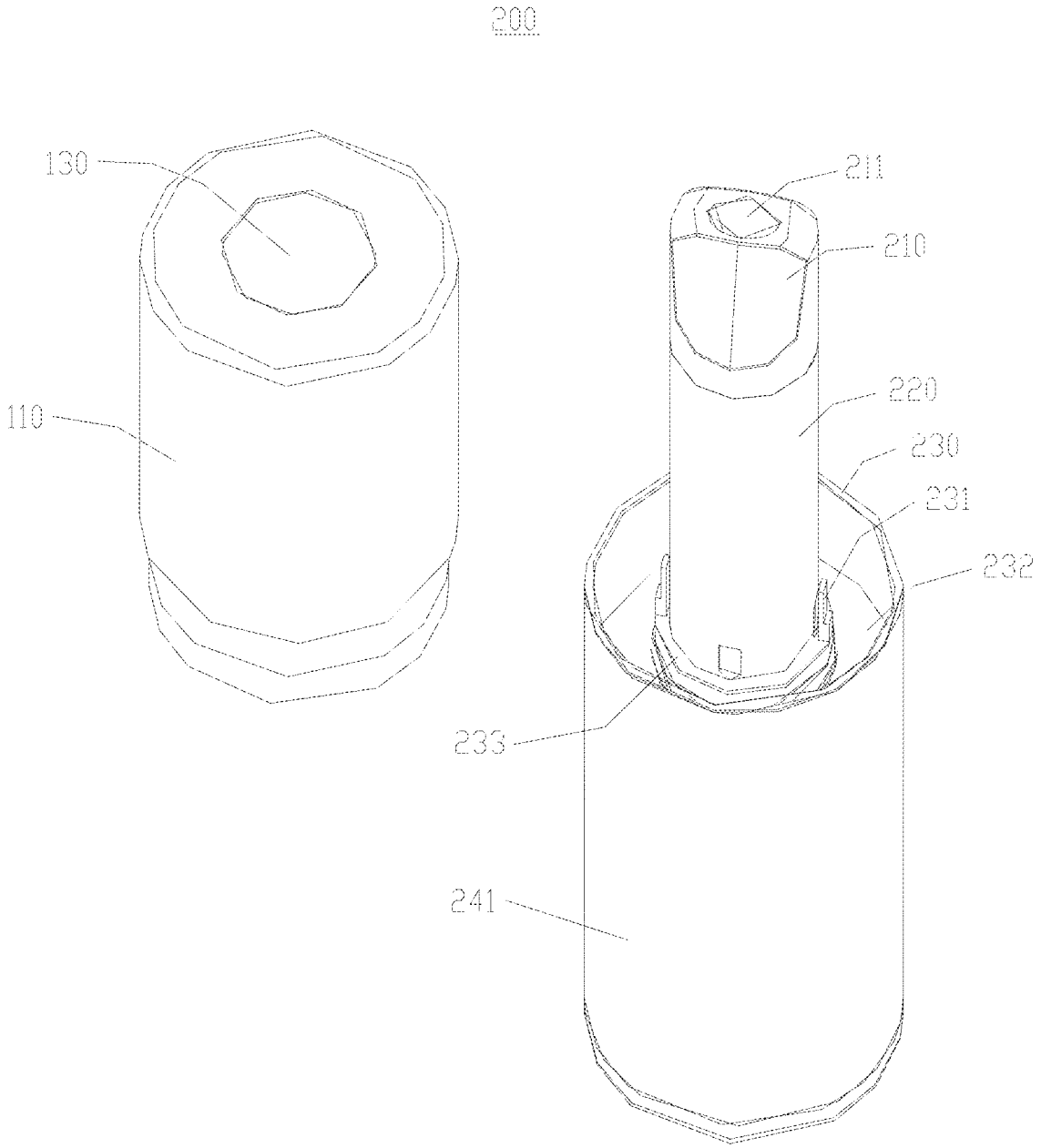
FIG. 2 is an exploded view of an electronic cigarette body and an expanded tobacco liquid bottle according to the present invention.
Figure 3:
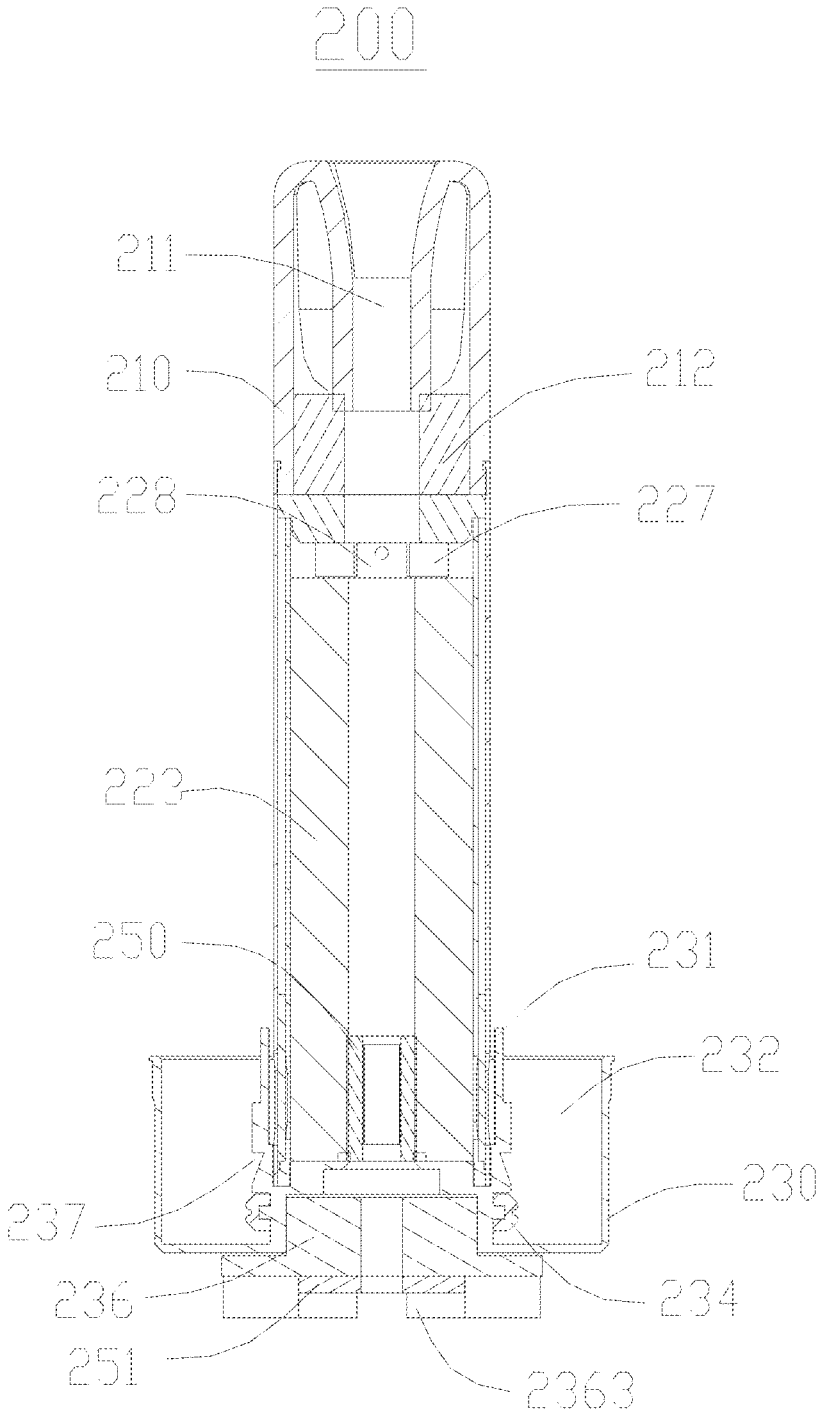
FIG. 3 is a sectional view of an upper half of an electronic cigarette body along a centre line according to the present invention.
Figure 4:
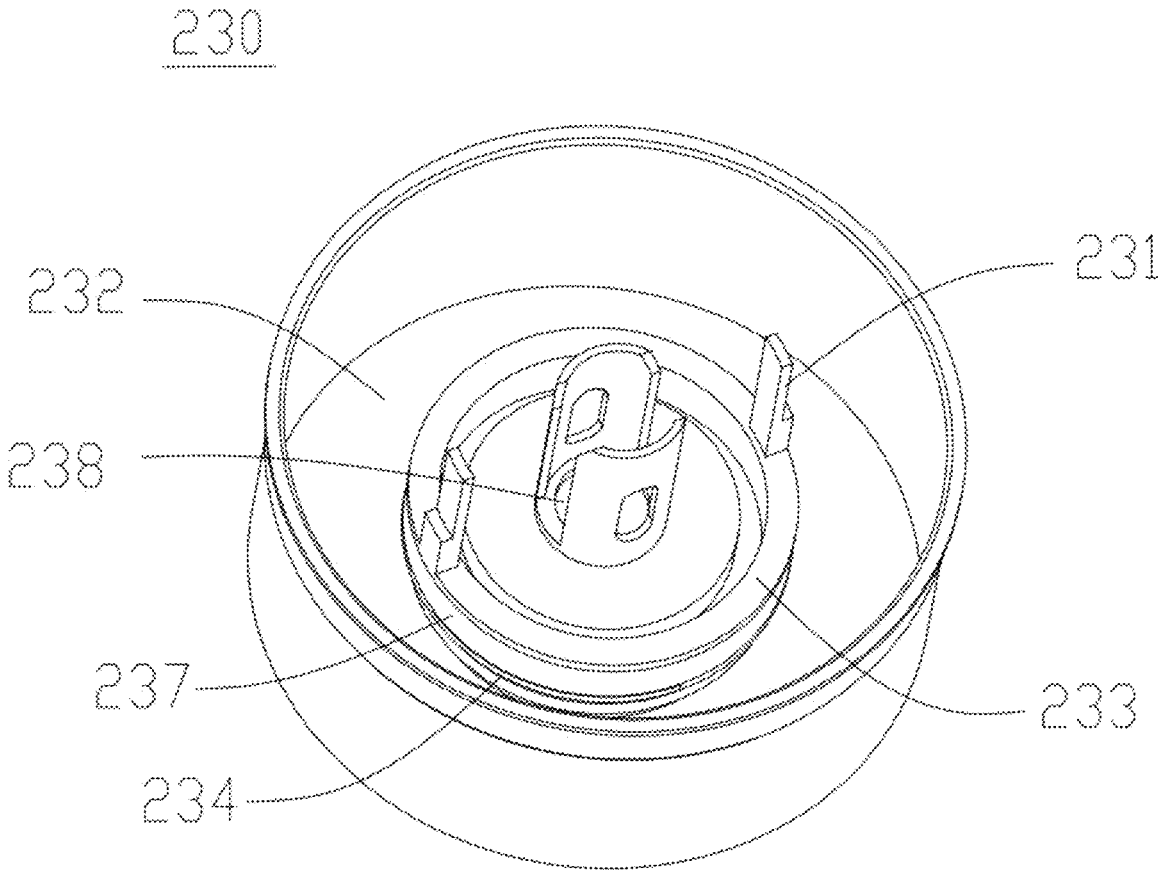
FIG. 4 is a structural diagram of a connection seat according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

FIGS. 1-12 show an electronic cigarette assembly in embodiments of the present invention.

Referring to FIGS. 1-8, the electronic cigarette assembly includes an electronic cigarette body 200 and an expanded tobacco liquid bottle 100 installed on the electronic cigarette body 200. The electronic cigarette body 200 includes a storage chamber 222. The storage chamber 222 is equipped with first liquid absorbing cotton 223 for storing tobacco liquid. The storage chamber 222 is provided with a first liquid passing hole 226 in communication with an interior. The expanded tobacco liquid bottle is configured for storing tobacco liquid, and the expanded tobacco liquid bottle 100 is provided with second liquid passing holes 125. The expanded tobacco liquid bottle 100 is equipped with a movable part 150. When the expanded tobacco liquid bottle 100 is not assembled with the electronic cigarette body 200, the movable part 150 covers the second liquid passing holes 125 to prevent tobacco liquid from flowing out of the second liquid passing holes 125. When the expanded tobacco liquid bottle 100 is assembled with the electronic cigarette body 200, the movable part 150 moves to open the second liquid passing holes 125, and the second liquid passing holes 125 are in communication with the first liquid passing hole 226.

In this embodiment, when the expanded tobacco liquid bottle 100 is installed on the electronic cigarette body 200, the movable part 150 moves to open the second liquid passing holes 125, so that the second liquid passing holes 125 are in communication with the first liquid passing hole 226. This allows the tobacco liquid on the expanded tobacco liquid bottle 100 to pass through the second liquid passing holes 125 and the first liquid passing hole 226 to be adsorbed by the first liquid absorbing cotton 223, thereby increasing a capacity of the tobacco liquid and improving a service life of the electronic cigarette body 200.

In one embodiment, the electronic cigarette body 200 includes a connection seat 230 provided on the storage chamber 222. An upper surface of the connection seat 230 is further provided with an embedding slot 232, and the embedding slot 232 is in communication with the first liquid passing hole 226. The embedding slot 232 is equipped with pushing members 231. A perforating hole 130 is provided on the expanded tobacco liquid bottle 100, and the perforating hole 130 runs through the expanded tobacco liquid bottle 100 from top to bottom. When the expanded tobacco liquid bottle 100 is assembled with the electronic cigarette body 200, the expanded tobacco liquid bottle 100 is sleeved on an outer side of the storage chamber 222, and at least part of the storage chamber 222 is placed in the perforating hole 130. A bottom end of the expanded tobacco liquid bottle 100 is placed in the embedding slot 232. When the bottom end of the expanded tobacco liquid bottle 100 is placed in the embedding slot 232, the movable part 150 abuts against the pushing members 231 and is pushed upwards to open the first liquid passing hole 226, so that the second liquid passing holes 125 are in communication with the perforating hole 130. Alternatively, when the bottom end of the expanded tobacco liquid bottle 100 is placed in the embedding slot 232, the movable part 150 engages with the pushing members 231, and when the expanded tobacco liquid bottle 100 rotates relative to the electronic cigarette body 200, the movable part 150 is pushed by the pushing members 231 to open the first liquid passing hole 226, so that the second liquid passing holes 125 are in communication with the perforating hole 130. By using the pushing members 231, when the expanded tobacco liquid bottle 100 is assembled with the electronic cigarette body 200, the movable part 150 is pushed to open the first liquid passing hole 226.

It should be noted that after the tobacco liquid in the electronic cigarette body 200 is used up, this structure can be used for adding tobacco liquid to the electronic cigarette body 200 without opening the storage chamber 222, making it convenient for the user to operate.

In other embodiments, it's possible that the expanded tobacco liquid bottle 100 is not placed on an outer side of the storage chamber 222. For example, when the electronic cigarette body 200 is assembled, the expanded tobacco liquid bottle 100 can be positioned on one side of the storage chamber 222. It is only necessary that the second liquid passing holes 125 are in communication with the first liquid passing hole 226 during an assembly of the expanded tobacco liquid bottle 100 together with the electronic cigarette body 200.

In one embodiment, a joint structure 272 is provided between a side wall of the embedding slot 232 and the expanded tobacco liquid bottle 100. The joint structure 272 includes a fixed slot 237 and a convex block 271. When a bottom end of the expanded tobacco liquid bottle 100 is placed in the embedding slot 232, the convex block 271 is placed in the fixed slot 237 to fixedly connect the expanded tobacco liquid bottle 100 with the electronic cigarette body 200.

Specifically, in order to facilitate a connection between the fixed slot 237 and the convex block 271, a side surface of the convex block 271 can be inclined or curved.

In an embodiment where the expanded tobacco liquid bottle 100 of the electronic cigarette assembly is replaceable, the convex block 271 together with the fixed slot 237 is a detachable buckle structure, such as an outer surface of the convex block 271 being curved or a cross-section being trapezoidal, so that under an action of external forces, the convex block 271 is capable of detaching from the fixed slot 237.

In one embodiment, the connection seat 230 is provided with a connection protruding stage 233 on the embedding slot 232. The pushing members 231 are provided on the connection protruding stage 233. The fixed slot 237 is positioned on an outer side wall of the connection protruding stage 233, and the convex block 271 is positioned on a side wall of the perforating hole 130. Of course, in other embodiments, it's possible that the fixed slot 237 is positioned on the side wall of the perforating hole 130, and the convex block 271 is positioned on the outer side wall of the protruding stage.

In the above embodiments, a first sealing ring 234 is provided between the connection protruding stage 233 and the expanded tobacco liquid bottle 100. The first sealing ring 234 is positioned below the joint structure 272 to prevent tobacco liquid from leaking out from a bottom when the expanded tobacco liquid bottle 100 is sleeved on the storage chamber 222.

In one embodiment, an annular cavity 180 is provided inside the expanded tobacco liquid bottle 100 for storing tobacco liquid. The annular cavity 180 is arranged around the perforating hole 130, and the second liquid passing holes 125 are arranged on a side wall of the perforating hole 130. A total number of the second liquid passing holes 125 is multiple, and position limiting columns 121 are provided between two adjacent second liquid passing holes 125. The movable part 150 includes a bottom plate 152 and an enclosure wall 151 set on the bottom plate 152. The enclosure wall 151 is placed inside the annular cavity 180. Position limiting holes 153 are provided on the bottom plate 152. The position limiting columns 121 are placed inside the position limiting holes 153. The bottom plate 152 is at least partially placed inside the perforating hole 130 and used in conjunction with the pushing members 231. By utilizing the enclosure wall 151, when the expanded tobacco liquid bottle 100 is not installed on the electronic cigarette body 200, the second liquid passing holes 125 can be closed, and when the expanded tobacco liquid bottle 100 is installed on the electronic cigarette body 200, the second liquid passing holes 125 can be opened. And by using the position limiting holes 153 in conjunction with the position limiting columns 121, the movable part 150 can stably move upwards, playing a position limiting role in directional movement.

In other embodiments, a total number of the second liquid passing hole 125 can also be only one, that is, a side wall next to the second liquid passing hole 125 can be equivalent to the position limiting columns 121, and the position limiting holes 153 can be a notch to adapt to the use of the position limiting columns 121, playing a position limiting role when the movable part 150 moves up and down.

Figure 5:
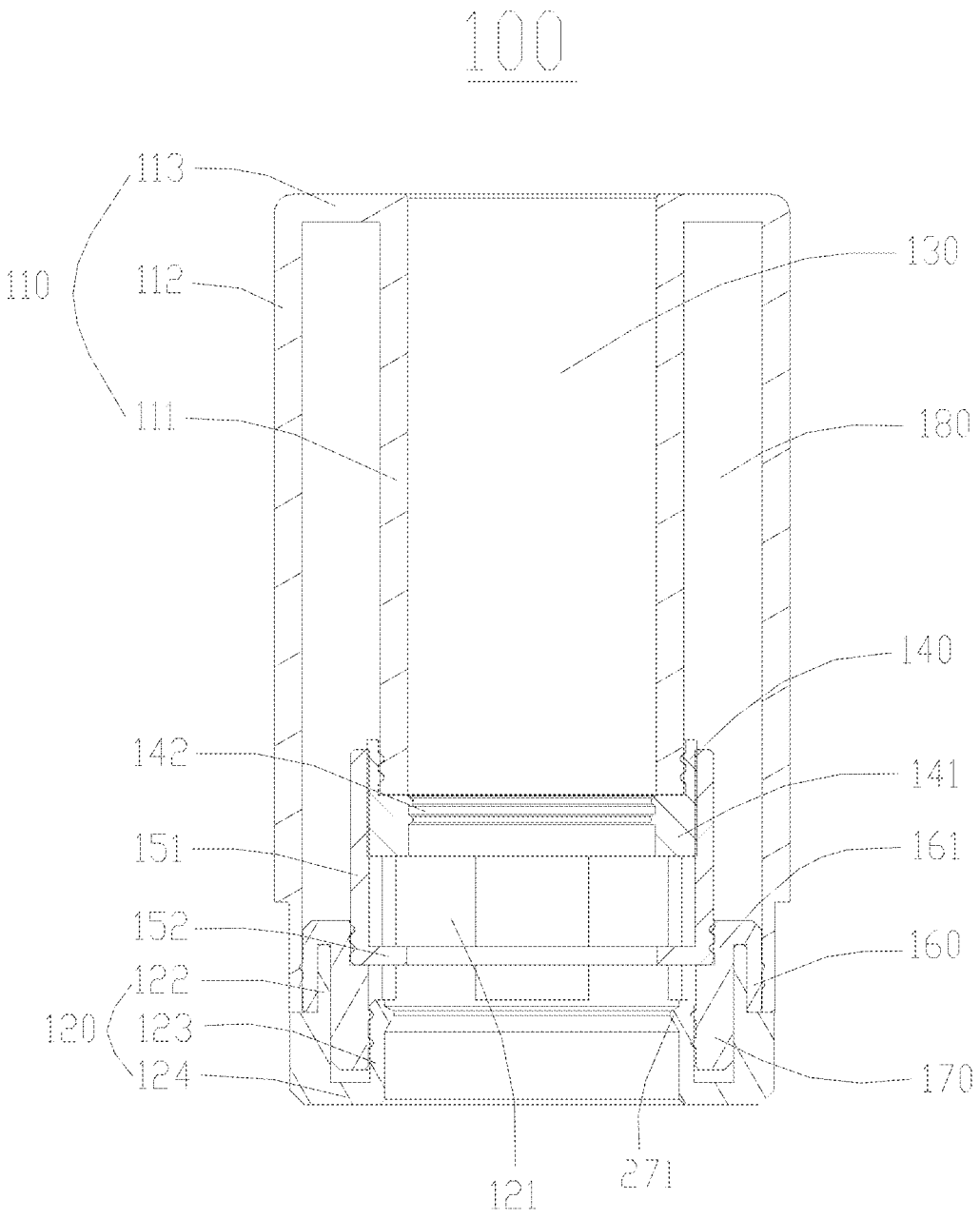
FIG. 5 is a sectional view of an expanded tobacco liquid bottle along a centre line according to the present invention.
Figure 6:
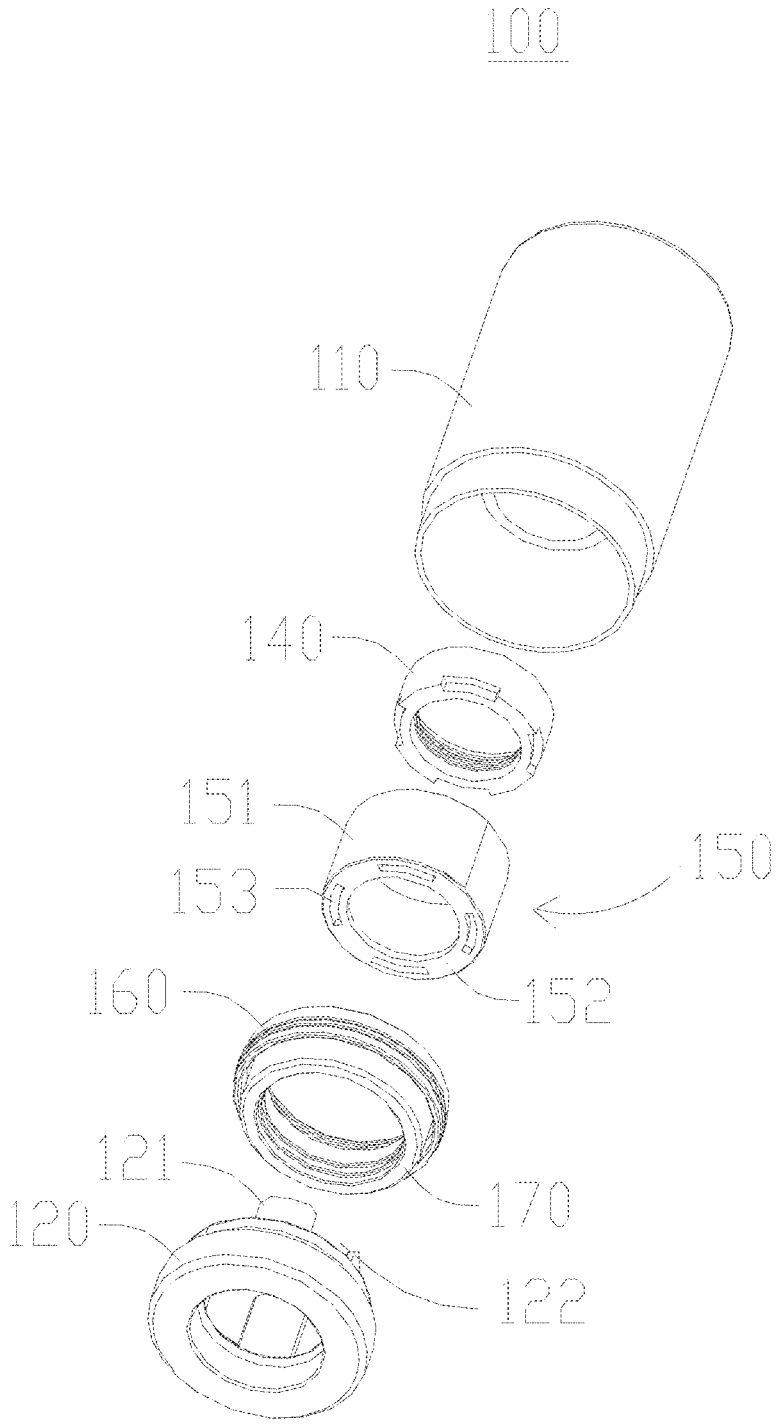
FIG. 6 is an exploded view of an expanded tobacco liquid bottle according to the present invention.
Figure 7:
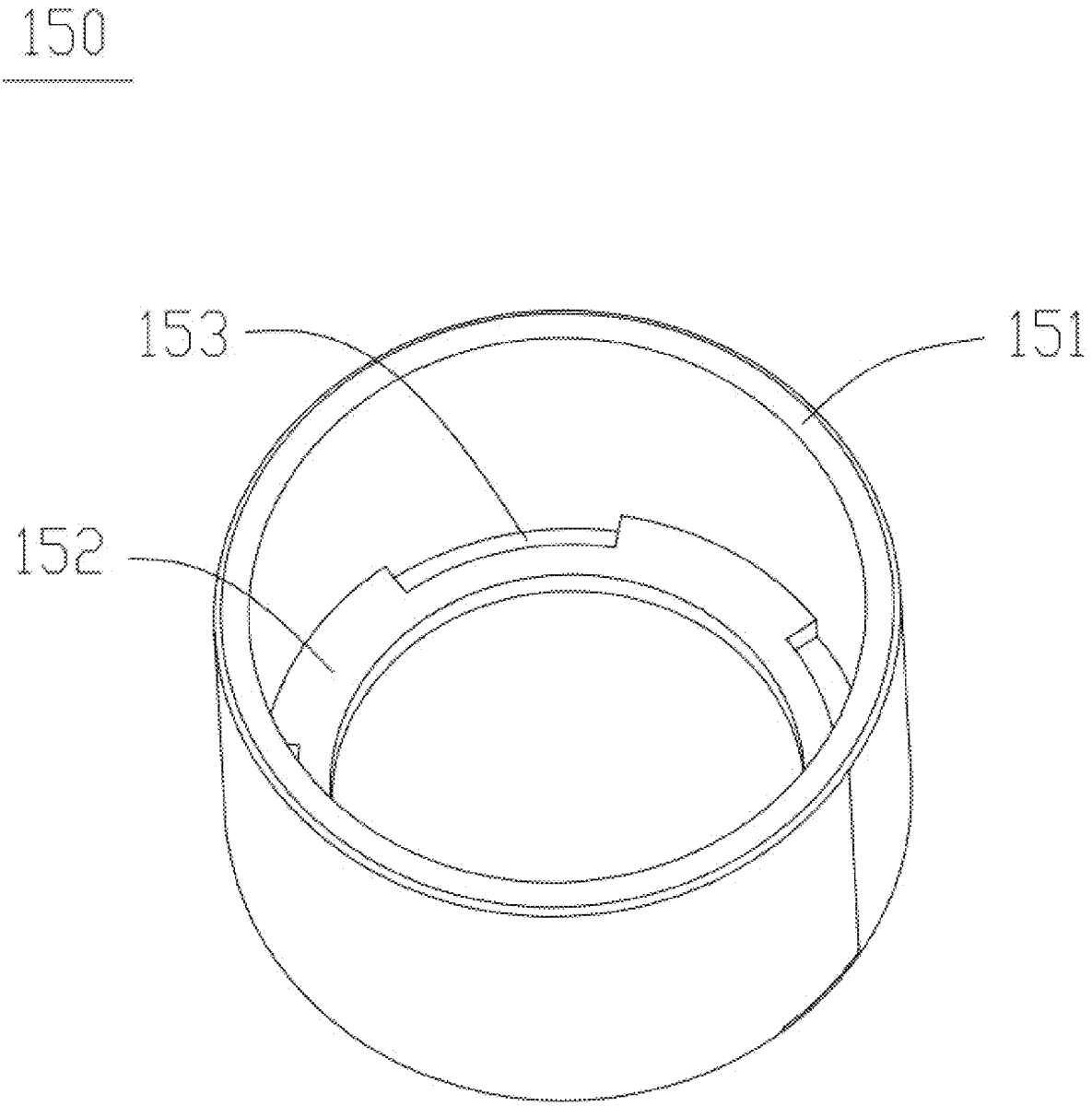
FIG. 7 is a structural diagram of a movable part according to the present invention.
Figure 8:
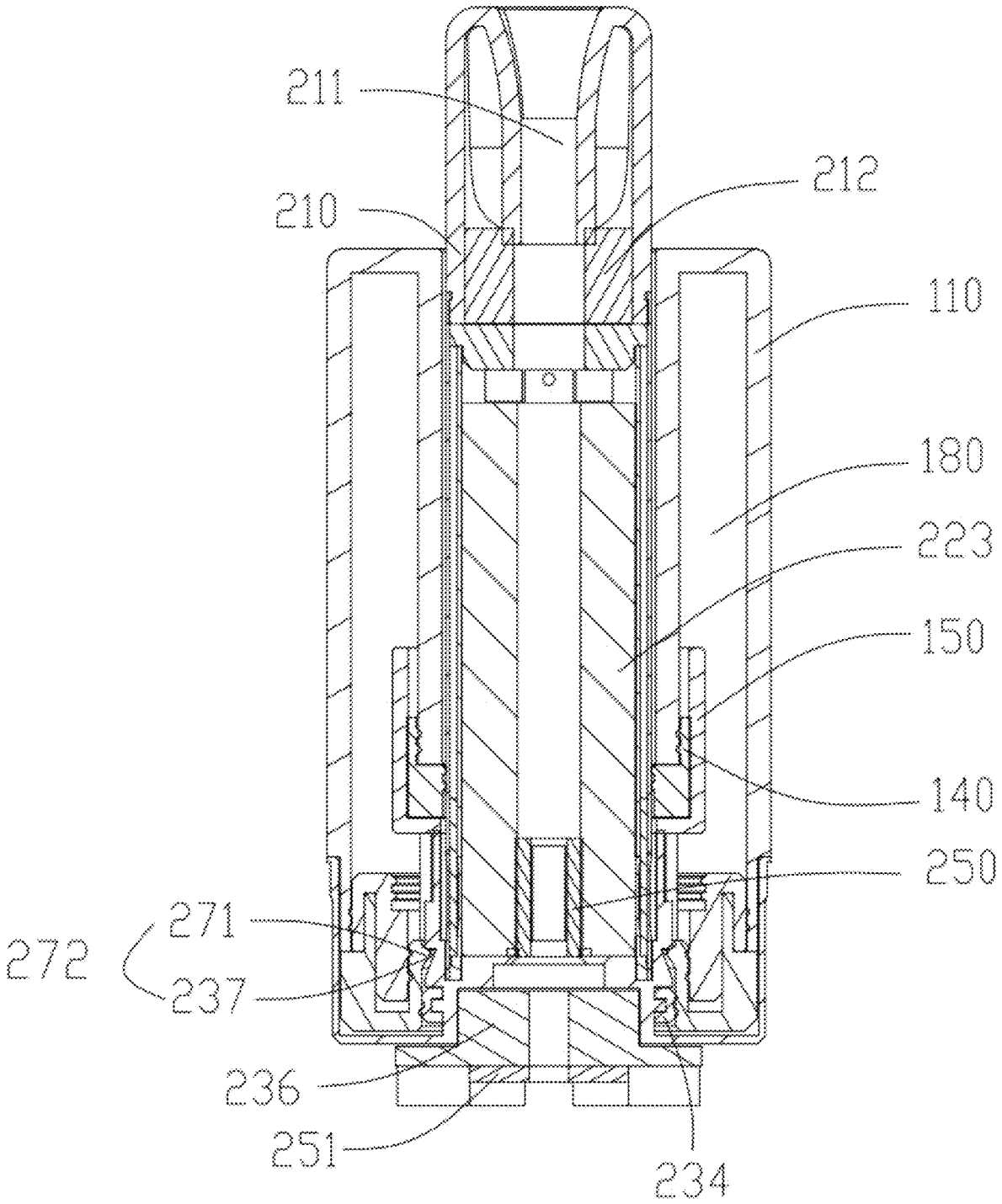
FIG. 8 is a sectional view along a center line of an upper half of an electronic cigarette body and an expanded tobacco liquid bottle after assembly according to the present invention.

Specifically, referring to FIGS. 5-7, in one embodiment, in order to facilitate production and manufacturing of the expanded tobacco liquid bottle 100, the expanded tobacco liquid bottle 100 includes a first housing body 110 and a first bottom housing 120, and the first bottom housing 120 is arranged at a bottom of the first housing body 110. The first housing body 110 includes a first annular wall 112, a second annular wall 111 positioned within the first annular wall 112, and a top wall 113. Two sides of the top wall 113 are respectively connected to the first annular wall 112 and the second annular wall 111. The first bottom housing 120 includes a third annular wall 122, a fourth annular wall 123, and a bottom wall 124. Two sides of the bottom wall 124 are respectively connected to the third annular wall 122 and the fourth annular wall 123. The first annular wall 112 is connected to the third annular wall 122 to connect the first housing body 110 to the first bottom housing 120. The second liquid passing holes 125 are positioned on the fourth annular wall 123. An annular chamber is composed of the first annular wall 112, the second annular wall 111, the top wall 113, the third annular wall 122, the fourth annular wall 123, and the bottom wall 124. The convex block 271 is positioned on the fourth annular wall 123. A second sealing ring 140 is arranged between the second annular wall 111 and the enclosure wall 151, and a third sealing ring 160 is arranged between the first annular wall 112 and the third annular wall 122. A fourth sealing ring 161 is provided between the enclosure wall 151 and the third annular wall 122, so as to prevent the tobacco liquid from leaking out from a gap between the first bottom housing 120 and the first housing body 110, playing a sealing role. Moreover, by using the second sealing ring 140, when the expanded tobacco liquid bottle 100 is not installed on the electronic cigarette body 200, the enclosure wall 151 is capable of closing the second liquid passing holes 125, and when the expanded tobacco liquid bottle 100 is installed on the electronic cigarette body 200, the movable part 150 is pushed upwards by the pushing members 231 to open the second liquid passing holes 125.

In one embodiment, a bottom of the second sealing ring 140 is connected to an annular rubber ring 141. An upper surface and a lower surface of the annular rubber ring 141 respectively abut against a top surface of the second annular wall 111 and the position limiting columns 121, so that the annular rubber ring 141 is compacted. The annular rubber ring 141 is used for fixing the second sealing ring 140 to prevent displacement of the second sealing ring 140 from affecting an sealing effect when the movable part 150 moves upwards.

In one embodiment, a total number of the pushing members 231 is multiple and the pushing members 231 are evenly distributed, so as to increase a contact area between the pushing members 231 and the movable part 150, and to enable the movable part 150 to move upwards more stably.

In one embodiment, a rubber ring protrusion 142 is provided on an inner side of the annular rubber ring 141, and the rubber ring protrusion 142 protrudes from a side wall of the perforating hole 130. By using the rubber ring protrusion 142 to press against the storage chamber 222, the tobacco liquid can be prevented from leaking out from a top after coming out of the second liquid passing holes 125, further preventing liquid leakage.

In one embodiment, the third sealing ring 160 is connected to the fourth sealing ring 161, and a fifth sealing ring 170 is provided at a bottom of the fourth sealing ring 161. The fifth sealing ring 170 is positioned between the third annular wall 122 and the fourth annular wall 123. A top surface of the fifth sealing ring 170 is at least partially opposite to a bottom surface of the bottom plate 152, so that when the expanded tobacco liquid bottle 100 is not installed on the electronic cigarette body 200, the bottom of the bottom plate 152 is capable of abutting against the fifth sealing ring 170, as shown in FIG. 5, playing a role of sealing the expanded tobacco liquid bottle 100.

In one embodiment, in order to reduce production steps and facilitate an installation of the third sealing ring 160 and the fourth sealing ring 161, the third sealing ring 160, the fourth sealing ring 161 and the fifth sealing ring 170 are integrally formed by injection molding, and the sixth rubber ring and the annular rubber ring 141 are integrally formed by injection molding.

Figure 9:
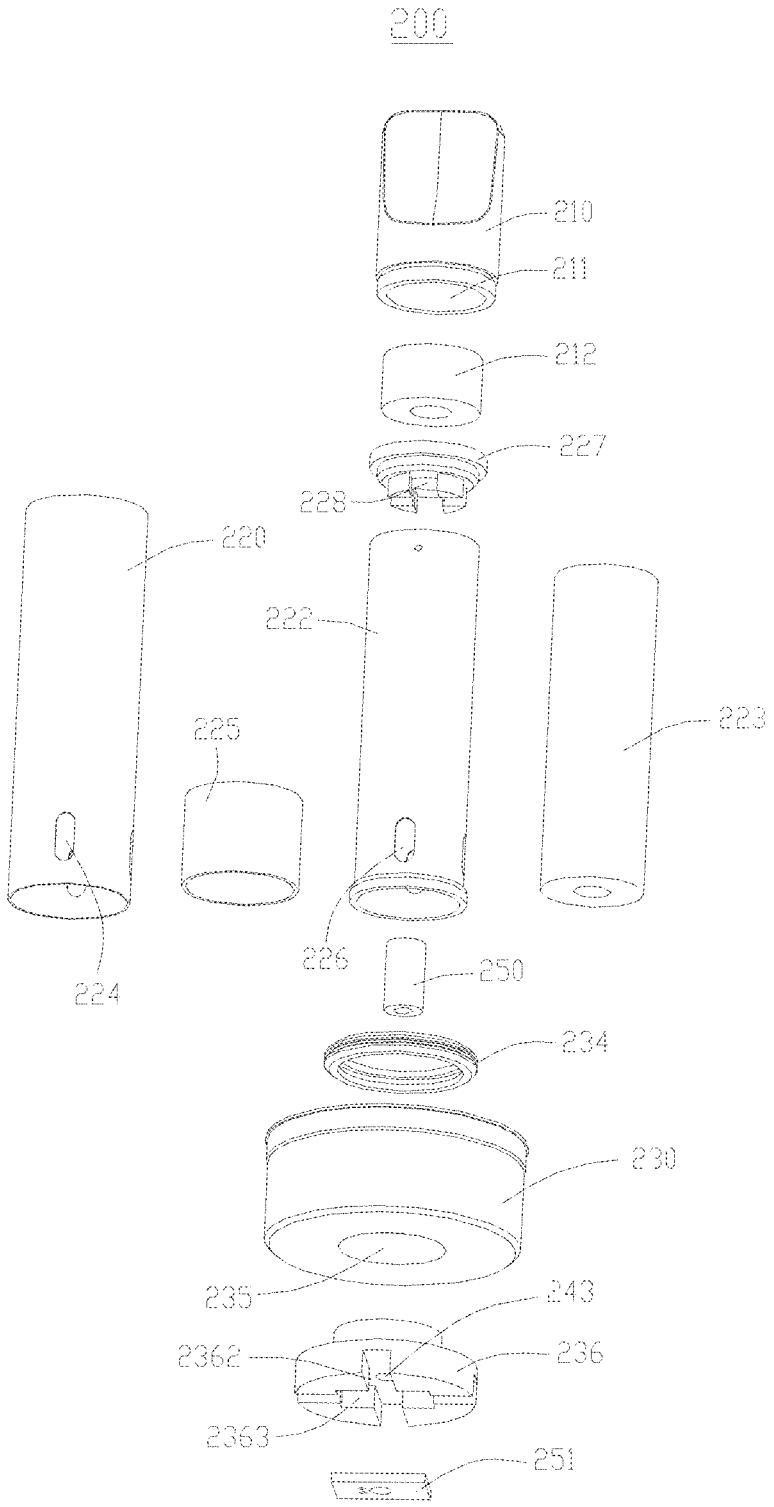
FIG. 9 is an exploded view of an upper half of an electronic cigarette body according to the present invention.

Referring to FIG. 9, in one embodiment, the electronic cigarette body 200 further includes a first outer housing 220, and the first outer housing 220 is sleeved on an outer side of the storage chamber 222. The first outer housing 220 is equipped with a third liquid passing hole 224 at a position corresponding to the first liquid passing hole 226, and liquid guiding cotton 225 is arranged between the first liquid passing hole 226 and the third liquid passing hole 224. By using the liquid guiding cotton 225, the tobacco liquid on the expanded tobacco liquid bottle 100 can be directed into the storage chamber 222. However, the liquid guiding cotton 225 can also effectively limit the tobacco liquid from the expanded tobacco liquid bottle 100 from entering the storage chamber 222, playing a flow limiting role, preventing the tobacco liquid from accumulating on the first liquid absorbing cotton 223 of the storage chamber 222, and preventing the user from inhaling the tobacco liquid together when puffing. Moreover, the liquid guiding cotton 225 is also capable of preventing the tobacco liquid from leaking out of the storage chamber 222, playing a role in preventing liquid leakage. Specifically, the material of the liquid guiding cotton 225 is consistent with the material of the first liquid absorbing cotton 223.

In one embodiment, the liquid guiding cotton 225 is in an annular shape and is sleeved on an outer side wall of the storage chamber 222. A height of the liquid guiding cotton 225 is greater than a height of the first liquid passing hole 226 or the third liquid passing hole 224. In other embodiments, the liquid guiding cotton 225 may not be in an annular shape, but in a block shape, and covers the first liquid passing hole 226 and the third liquid passing hole 224.

In the above embodiments, a bottom of the storage chamber 222 is equipped with an atomizer 250 and a mouthpiece 210, and the mouthpiece 210 is provided on the first outer housing 220. An opening is defined at a top of the storage chamber 222, and a sealing rubber plug 227 is provided at the opening. An aerosol passing hole 211 is provided on the mouthpiece 210. The sealing rubber plug 227 is provided with an aerosol outlet hole 228, and the aerosol outlet hole 228 is internally in communication with the aerosol passing hole 211 and the storage chamber 222. The atomizer 250 works to atomize the tobacco liquid into aerosol, and the aerosol can be inhaled by the user through the aerosol outlet hole 228 and the aerosol passing hole 211.

In one embodiment, second liquid absorbing cotton 212 is provided inside the aerosol passing hole 211 for tobacco liquid absorbing and/or filtration. The second liquid absorbing cotton 212 is capable of filtering aerosol and also absorbing the tobacco liquid that is sucked out, preventing the tobacco liquid from being sucked into the user's mouth.

Figure 10:
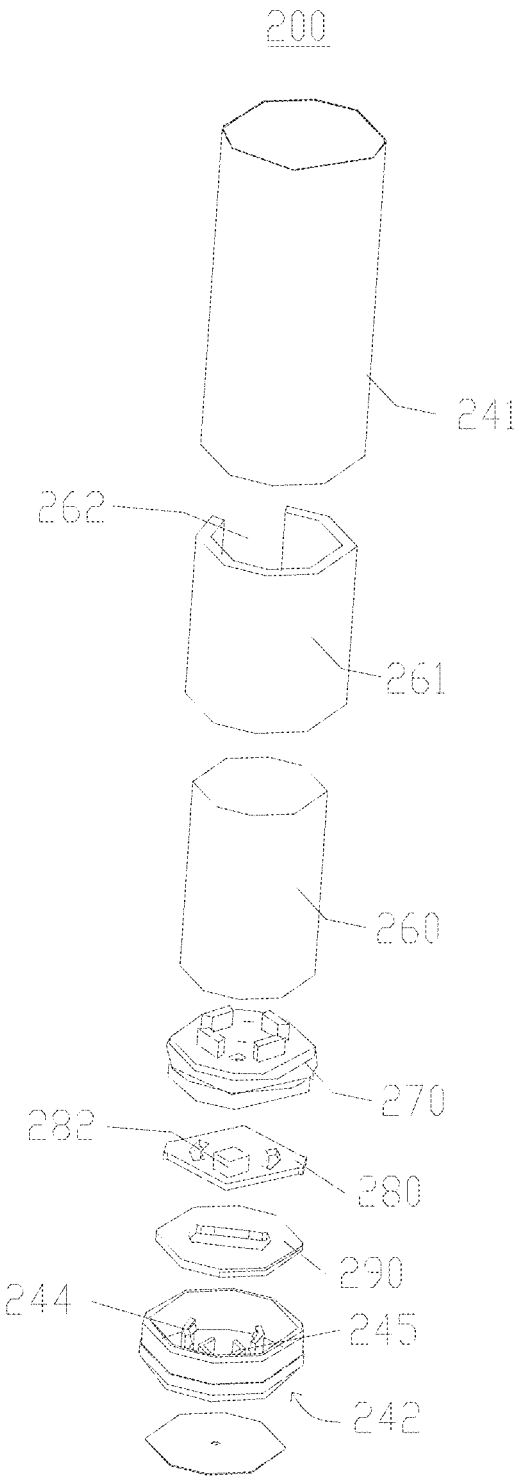
FIG. 10 is an exploded view of a lower half of an electronic cigarette body according to the present invention.
Figure 11:
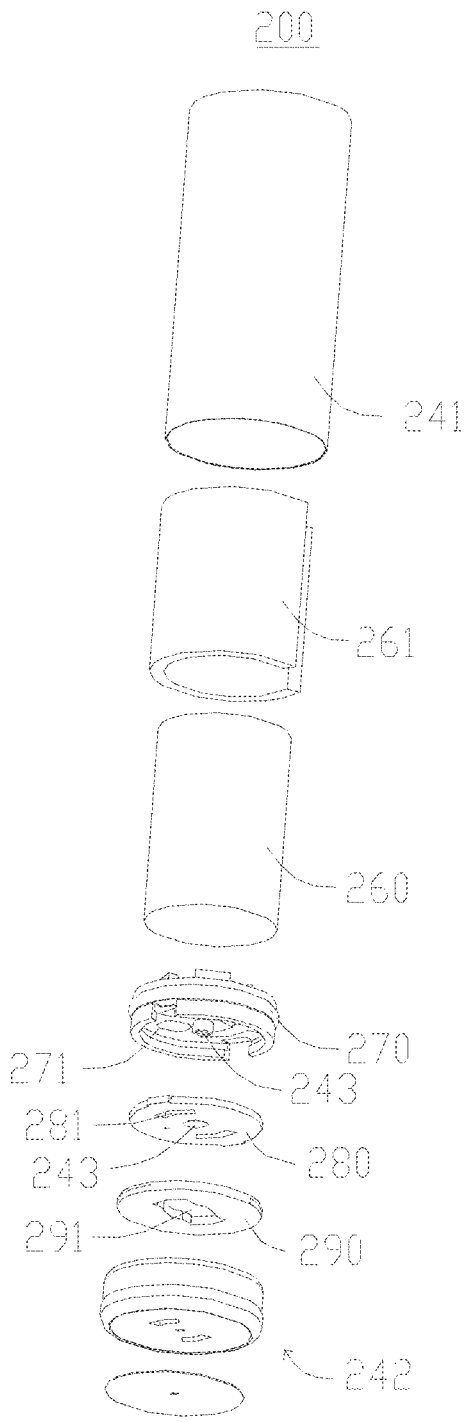
FIG. 11 is an exploded view of a lower half of an electronic cigarette body from another perspective according to the present invention.
Figure 12:
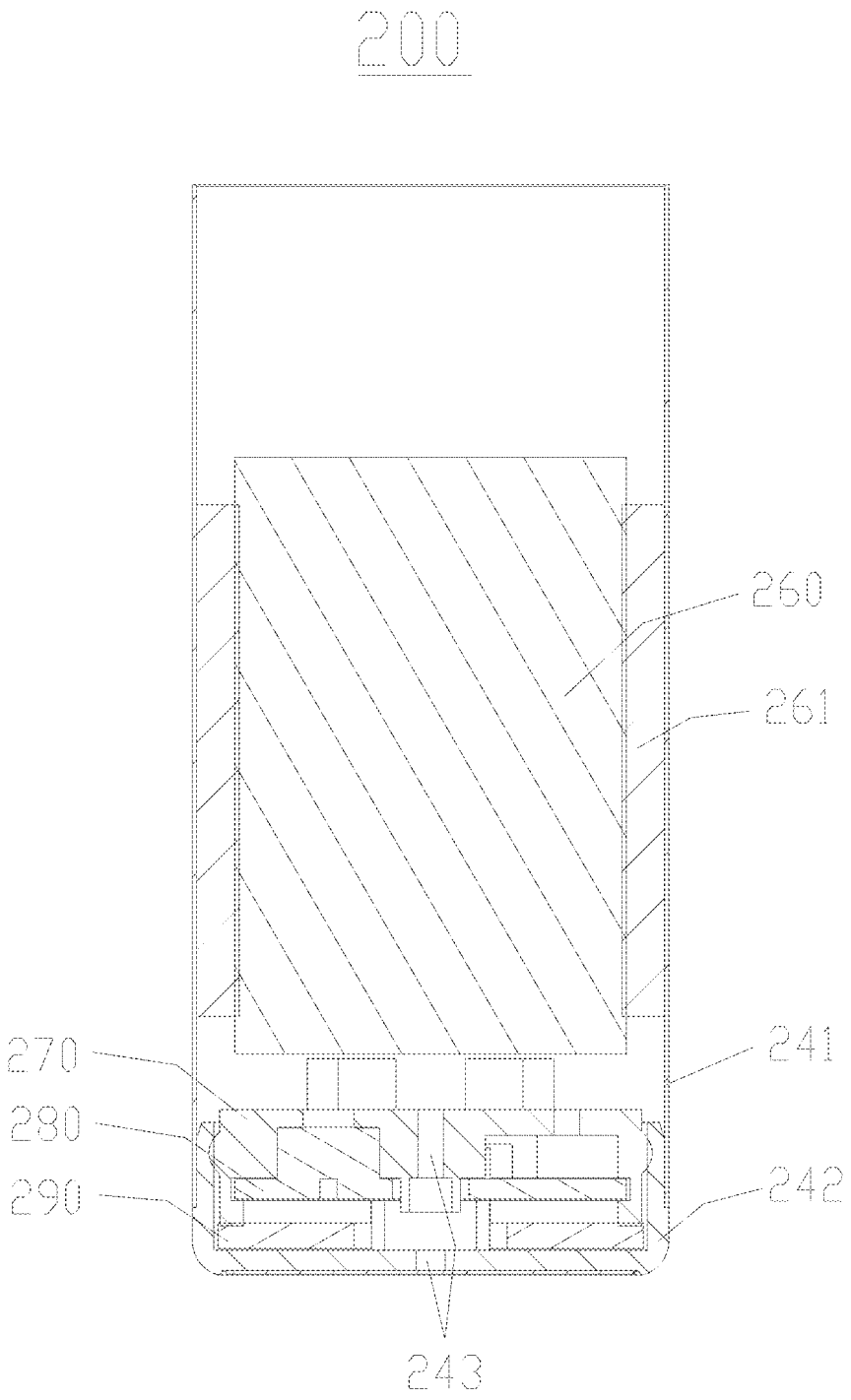
FIG. 12 is a sectional view of a lower half of an electronic cigarette body along a centre line according to the present invention.

Referring to FIGS. 10-12, in the above embodiments, the electronic cigarette body 200 further includes a second outer housing 241, a circuit board 280 and a battery 260. The second outer housing 241 is connected to the connection seat 230 and is positioned below the connection seat 230. The circuit board 280 and the battery 260 are arranged inside the second outer housing 241. The battery 260 and the atomizer 250 are both electrically connected to the circuit board 280. The battery 260 is arranged to power the circuit board 280, and the circuit board 280 is arranged to drive the atomizer 250 to operate.

In disposable electronic cigarettes, the battery 260 can be a disposable battery 260. Of course, in practical application, the battery 260 can also be a rechargeable battery 260. The second outer housing 241 is equipped with a charging port electronically connected to the circuit board 280. When the charging port is connected to an external power source, the battery 260 can be charged through the circuit board 280.

In one embodiment, a buffer pad 261 is provided between the battery 260 and an inner side wall of the second outer housing 241 to protect the battery 260 and improve the reliability of the product.

Referring to FIG. 9, in one embodiment, in order to facilitate an installation of the atomizer 250, an adapter board 251 electrically connected to circuit board 280 is provided at a bottom of the connection seat 230. A first wiring hole 238 is arranged on the connection seat 230, and a pin of a heating wire on the atomizer 250 is soldered onto the adapter board 251 through the first wiring hole 238. Specifically, the adapter board 251 can be fixed to the bottom of the connection seat 230 by screws, buckles, or pasting.

In one embodiment, a groove 235 is provided at a bottom of the connection seat 230, and the electronic cigarette body 200 further includes a first rubber seat 236. A top of the first rubber seat 236 is in interference fit with the groove 235 to fix the first rubber seat 236. A bottom of the first rubber seat 236 is equipped with a first installation chamber 2363, and the adapter board 251 is placed inside the first installation chamber 2363 and is in interference fit with the first installation chamber 2363 to fix the adapter board 251. A second wiring hole 2362 is arranged at a position corresponding to the first wiring hole 238 on the first rubber seat 236 to provide an avoiding space for the pin of the heating wire on the atomizer 250.

Referring to FIGS. 10-12, in the above embodiments, the electronic cigarette body 200 further includes a second bottom housing 242. An upper end and a lower end of the second outer housing 241 are respectively connected to the connection seat 230 and the second bottom housing 242. The second bottom housing 242 is equipped with a second rubber seat 270. The second rubber seat 270 is in interference fit with the second bottom housing 242, so that the second rubber seat 270 is fixed. A bottom surface of the second rubber seat 270 is provided with a second installation chamber 271, and the circuit board 280 is placed inside the second installation chamber 271. The circuit board 280 can be in interference fit with the second rubber seat 270 or connected through a buckle.

In one embodiment, the electronic cigarette body 200 further includes a light board 290 electrically connected to the circuit board 280, and the light board 290 is positioned between the second bottom housing 242 and the second rubber seat 270. By utilizing the interference fit between the second rubber seat 270 and the second bottom housing 242, the light board 290 can be pressed tightly. Moreover, when the light board 290 emits light, the second rubber seat 270 is capable of playing a light guiding role, and with the light-transmittable second bottom housing 242, the light can be guided out. The second bottom housing 242 is equipped with support columns 245 and positioning columns 244. A top surface of the support columns 245 abuts against the circuit board 280, and positioning holes 281 are provided on the circuit board 280. The positioning columns 244 are placed inside the positioning holes 281, and an avoidance hole 291 is provided in a middle of the light board 290. Both the positioning columns 244 and the support columns 245 are placed inside the avoidance hole 291, so that the circuit board 280 and the light board 290 can be separated and compactly arranged, making a volume of the electronic cigarette body 200 compact.

In one embodiment, an airflow hole 243 is provided on the second bottom housing 242, the first rubber seat 236, the circuit board 280, the adapter board 251, and the second rubber seat 270. A pneumatic switch 282 is provided on the circuit board 280, and an airflow channel 262 is arranged between the buffer pad 261, the battery 260, and the second outer housing 241. When the user puffs through the mouthpiece 210, air enters through the airflow hole 243 on the second bottom housing 242, and the pneumatic switch 282 detects the air entering. The circuit board 280 drives the atomizer 250 to atomize the tobacco liquid to form aerosol. The air then passes through the avoidance hole 291 on the light board 290, the airflow hole 243 on the circuit board 280, the airflow hole 243 on the second rubber seat 270, the airflow channel 262, the airflow hole 243 on the adapter board 251, the airflow hole 243 on the first rubber seat 236, the atomizer 250, the storage chamber 222, the aerosol outlet hole 228, and the aerosol passing hole 211 in sequence to be inhaled by the user to form a circulating airflow, making the aerosol be inhaled by the user through the aerosol outlet hole 228 and the aerosol passing hole 211.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An electronic cigarette assembly, comprising an electronic cigarette body and an expanded tobacco liquid bottle installed on the electronic cigarette body;

wherein the electronic cigarette body comprises a storage chamber, the storage chamber is equipped with first liquid absorbing cotton for storing tobacco liquid, and the storage chamber is provided with a first liquid passing hole in communication with an interior of the storage chamber;

the expanded tobacco liquid bottle is configured for storing tobacco liquid, the expanded tobacco liquid bottle is provided with second liquid passing holes, and the expanded tobacco liquid bottle is equipped with a movable part;

when the expanded tobacco liquid bottle is not assembled with the electronic cigarette body, the movable part covers the second liquid passing holes to prevent tobacco liquid from flowing out of the second liquid passing holes;

when the expanded tobacco liquid bottle is assembled with the electronic cigarette body, the movable part moves to open the second liquid passing holes, and the second liquid passing holes are in communication with the first liquid passing hole.

2. The electronic cigarette assembly of claim 1, wherein the electronic cigarette body comprises a connection seat provided on the storage chamber, an upper surface of the connection seat is further provided with an embedding slot, and the embedding slot is in communication with the first liquid passing hole; the embedding slot is equipped with pushing members, a perforating hole is provided on the expanded tobacco liquid bottle, and the perforating hole runs through the expanded tobacco liquid bottle from top to bottom;

when the expanded tobacco liquid bottle is assembled with the electronic cigarette body, the expanded tobacco liquid bottle is sleeved on an outer side of the storage chamber, and at least part of the storage chamber is placed in the perforating hole; a bottom end of the expanded tobacco liquid bottle is placed in the embedding slot;

when the bottom end of the expanded tobacco liquid bottle is placed in the embedding slot, the movable part abuts against the pushing members and is pushed upwards to open the first liquid passing hole, so that the second liquid passing holes are in communication with the perforating hole; alternatively, when the bottom end of the expanded tobacco liquid bottle is placed in the embedding slot, the movable part engages with the pushing members, and when the expanded tobacco liquid bottle rotates relative to the electronic cigarette body, the movable part is pushed by the pushing members to open the first liquid passing hole, so that the second liquid passing holes are in communication with the perforating hole;

a joint structure is provided between a side wall of the embedding slot and the expanded tobacco liquid bottle, and the joint structure comprises a fixed slot and a convex block; when the bottom end of the expanded tobacco liquid bottle is placed in the embedding slot, the convex block is placed in the fixed slot.

3. The electronic cigarette assembly of claim 2, wherein the connection seat is provided with a connection protruding stage on the embedding slot, the pushing members are provided on the connection protruding stage, and the fixed slot is positioned on an outer side wall of the connection protruding stage; the convex block is positioned on a side wall of the perforating hole.

4. The electronic cigarette assembly of claim 3, wherein a first sealing ring is provided between the connection protruding stage and the expanded tobacco liquid bottle, and the first sealing ring is positioned below the joint structure.

5. The electronic cigarette assembly of claim 4, wherein an annular cavity is provided inside the expanded tobacco liquid bottle for storing tobacco liquid, the annular cavity is arranged around the perforating hole, and the second liquid passing holes are arranged on a side wall of the perforating hole; a total number of the second liquid passing holes is multiple, and position limiting columns are provided between two adjacent second liquid passing holes;

the movable part comprises a bottom plate and an enclosure wall set on the bottom plate, and the enclosure wall is placed inside the annular cavity; position limiting holes are provided on the bottom plate, the position limiting columns are placed inside the position limiting holes, and the bottom plate is at least partially placed inside the perforating hole and used in conjunction with the pushing members.

6. The electronic cigarette assembly of claim 5, wherein the expanded tobacco liquid bottle comprises a first housing body and a first bottom housing, and the first bottom housing is arranged at a bottom of the first housing body;

the first housing body comprises a first annular wall, a second annular wall positioned within the first annular wall and a top wall, two sides of the top wall are respectively connected to the first annular wall and the second annular wall, and a second sealing ring is provided between the second annular wall and the enclosure wall;

the first bottom housing comprises a third annular wall, a fourth annular wall and a bottom wall, two sides of the bottom wall are respectively connected to the third annular wall and the fourth annular wall, the first annular wall is connected to the third annular wall, a third sealing ring is arranged between the first annular wall and the third annular wall, and a fourth sealing ring is provided between the enclosure wall and the third annular wall;

the second liquid passing holes are positioned on the fourth annular wall, an annular chamber is composed of the first annular wall, the second annular wall, the top wall, the third annular wall, the fourth annular wall and the bottom wall, and the convex block is positioned on the fourth annular wall.

7. The electronic cigarette assembly of claim 6, wherein a bottom of the second sealing ring is connected to an annular rubber ring, and an upper surface and a lower surface of the annular rubber ring respectively abut against a top surface of the second annular wall and the position limiting columns.

8. The electronic cigarette assembly of claim 7, wherein a total number of the pushing members is multiple and the pushing members are evenly distributed;

a rubber ring protrusion is provided on an inner side of the annular rubber ring, and the rubber ring protrusion protrudes from a side wall of the perforating hole.

9. The electronic cigarette assembly of claim 8, wherein the third sealing ring is connected to the fourth sealing ring, a fifth sealing ring is provided at a bottom of the fourth sealing ring, the fifth sealing ring is positioned between the third annular wall and the fourth annular wall, and a top surface of the fifth sealing ring is at least partially opposite to a bottom surface of the bottom plate;

the third sealing ring, the fourth sealing ring and the fifth sealing ring are integrally formed by injection molding, and the sixth rubber ring and the annular rubber ring are integrally formed by injection molding.

10. The electronic cigarette assembly of claim 6, wherein the electronic cigarette body further comprises a first outer housing, and the first outer housing is sleeved on an outer side of the storage chamber; the first outer housing is equipped with a third liquid passing hole at a position corresponding to the first liquid passing hole, liquid guiding cotton is arranged between the first liquid passing hole and the third liquid passing hole, and the liquid guiding cotton is used for guiding the tobacco liquid from the expanded tobacco liquid bottle into the storage chamber.

11. The electronic cigarette assembly of claim 10, wherein the liquid guiding cotton is in an annular shape and is sleeved on an outer side wall of the storage chamber; a height of the liquid guiding cotton is greater than a height of the first liquid passing hole or the third liquid passing hole.

12. The electronic cigarette assembly of claim 11, wherein a bottom of the storage chamber is equipped with an atomizer and a mouthpiece, and the mouthpiece is provided on the first outer housing; an opening is defined at a top of the storage chamber, and a sealing rubber plug is provided at the opening; an aerosol passing hole is provided on the mouthpiece, the sealing rubber plug is provided with an aerosol outlet hole, and the aerosol outlet hole is internally in communication with the aerosol passing hole and the storage chamber.

13. The electronic cigarette assembly of claim 12, wherein second liquid absorbing cotton is provided inside the aerosol passing hole for tobacco liquid absorbing and/or filtration.

14. The electronic cigarette assembly of claim 12, wherein the electronic cigarette body further comprises a second outer housing, a circuit board and a battery, the second outer housing is connected to the connection seat and is positioned below the connection seat, the circuit board and the battery are arranged inside the second outer housing, and the battery and the atomizer are both electrically connected to the circuit board.

15. The electronic cigarette assembly of claim 14, wherein a buffer pad is provided between the battery and an inner side wall of the second outer housing.

16. The electronic cigarette assembly of claim 15, wherein an adapter board electrically connected to circuit board is provided at a bottom of the connection seat, a first wiring hole is arranged on the connection seat, and a pin of a heating wire on the atomizer is soldered onto the adapter board through the first wiring hole.

17. The electronic cigarette assembly of claim 16, wherein a groove is provided at a bottom of the connection seat, and the electronic cigarette body further comprises a first rubber seat; a top of the first rubber seat is in interference fit with the groove, and a bottom of the first rubber seat is equipped with a first installation chamber; the adapter board is placed inside the first installation chamber and is in interference fit with the first installation chamber, and a second wiring hole is arranged at a position corresponding to the first wiring hole on the first rubber seat.

18. The electronic cigarette assembly of claim 17, wherein the electronic cigarette body further comprises a second bottom housing; an upper end and a lower end of the second outer housing are respectively connected to the connection seat and the second bottom housing, and the second bottom housing is equipped with a second rubber seat; the second rubber seat is in interference fit with the second bottom housing, a bottom surface of the second rubber seat is provided with a second installation chamber, and the circuit board is placed inside the second installation chamber.

19. The electronic cigarette assembly of claim 18, wherein an airflow hole is provided on the second bottom housing, the first rubber seat, the circuit board, the adapter board, and the second rubber seat; a pneumatic switch is provided on the circuit board, and an airflow channel is arranged between the buffer pad, the battery, and the second outer housing.

20. The electronic cigarette assembly of claim 19, wherein the electronic cigarette body further comprises a light board electrically connected to the circuit board, and the light board is positioned between the second bottom housing and the second rubber seat; the second bottom housing is equipped with support columns and positioning columns, a top surface of the support columns abuts against the circuit board, positioning holes are provided on the circuit board, and the positioning columns are placed inside the positioning holes; an avoidance hole is provided in a middle of the light board, and both the positioning columns and the support columns are placed inside the avoidance hole.

* * * * *